US006267025B1

(12) United States Patent
Sand et al.

(10) Patent No.: US 6,267,025 B1
(45) **Date of Patent: *Jul. 31, 2001**

(54) BROKEN PEDICLE SCREW EXTRACTOR

(75) Inventors: Paul M. Sand, Roseville; Adam Shinbrot, St. Louis Park, both of MN (US)

(73) Assignee: Sulzer Spine-Tech, Inc., Minneapolis, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/197,097

(22) Filed: Nov. 20, 1998

(51) Int. Cl.[7] ..... B25B 13/50
(52) U.S. Cl. ..... 81/53.2; 81/120
(58) Field of Search ..... 81/53.2, 120

(56) References Cited

U.S. PATENT DOCUMENTS

| | | | | |
|---|---|---|---|---|
| 3,106,233 | * | 10/1963 | Wolny | 81/53.2 X |
| 3,457,812 | * | 7/1969 | Wagner | 81/53.2 |
| 4,204,308 | * | 5/1980 | Marling | 81/53.2 X |
| 4,940,370 | * | 7/1990 | Gipson | 81/53.2 X |
| 5,737,981 | * | 4/1998 | Hildebrand | 81/53.2 |

* cited by examiner

*Primary Examiner*—James G. Smith
(74) *Attorney, Agent, or Firm*—Vidas, Arrett & Steinkraus

(57) ABSTRACT

A tool for extracting broken or otherwise damaged screws from bone or wood includes an elongated shaft having a tool engaging head on an upper end to allow rotational force to be applied. The other end includes an opening which includes tapered cutting threads that are sized to initially pass over the screw to be removed which will cut into and hold onto the screw upon turning the tool opposite to the threads of the screw. The other end opening defines a hole saw which will cut away the bone or wood around the screw to allow the inner cutting threads to engage the screw.

11 Claims, 2 Drawing Sheets

BROKEN PEDICLE SCREW EXTRACTOR

BACKGROUND OF THE INVENTION

This invention relates to a tool for extracting broken or damaged screws embedded in bone or wood. Pedicle screws are screws that are inserted into the pedicle of a human vertebra to secure a plate or the like to an adjacent vertebra. As with all screws, they may be damaged or broken during installation or through wear, requiring removal.

Prior art approaches to removal of damaged screws include using a plurality of sharp teeth in a tool to hold the metal of the screw while turning as shown in U.S. Pat. No. 2,750,821 to Hilsinger, a modified slotted blade with sharp leading edges as shown in U.S. Pat. No. 4,434,687 to Vickio or a tool that requires drilling a bore down the center of the damaged screw or bolt to receive a reverse threaded or fluted tool, commonly called an "easy-out" as shown in U.S. Pat. No. 1,547,944 to Murphree. U.S. Pat. No. 4,350,064 to Markle issued Sep. 21, 1982, shows a more recent approach in which an easy out is attachable to an electric drill or rachet wrench.

In medical applications, it may be very difficult to use an easy-out in that drilling a pilot hole generates metal filings which cannot be allowed to be left in the surgical site, especially in the vicinity of the spinal cord. A tool that will not require drilling and that would not generate metal fragments is highly desirable.

The art described in this section is not intended to constitute an admission that any patent, publication, or other information referred to herein is "prior art" with respect to this invention, unless specifically designated as such. In addition, this section should not be construed to mean that a search has been made or that no other pertinent information as defined in 37 C.F.R. § 1.56(a) exists.

BRIEF SUMMARY OF THE INVENTION

The invention provides a screw extractor, especially suited for medical applications such as removal of pedicle screws. The screw extractor has an elongated shaft with an upper and a lower end. The upper end is adapted to receive a source of rotational force. The lower end includes a central opening which includes tapered threads opposite the threads of a screw to be removed. The lower periphery of the end defines a hole saw to cut away the bone or wood into which the screw is inserted.

In operation, the extractor is positioned over the screw to be removed and is rotated allowing the hole saw to cut away the bone or wood surrounding the screw until the inner tapered threads bite into the screw enough that it may be rotated out of the substrate.

BRIEF DESCRIPTION OF THE DRAWINGS

A detailed description of the invention is hereafter described with specific reference being made to the drawings in which.

DETAILED DESCRIPTION OF THE INVENTION

The extractor 10 of the invention has an elongated shank 12 which may be substantially hollow or solid. The extractor has an upper end 14 which is shown with a Hudson adapter 16. The upper end 14 requires a mechanism that will allow rotational force to be supplied to the extractor. Accordingly, any of the conventional approaches known in the art may be applied, including, but not limited to, a hex head for wrenches. The Hudson adapter 16 is shown as the most common power attachment in a hospital environment. Any mechanism which allows rotational force to be applied is within the meaning of the invention.

Figure 1:
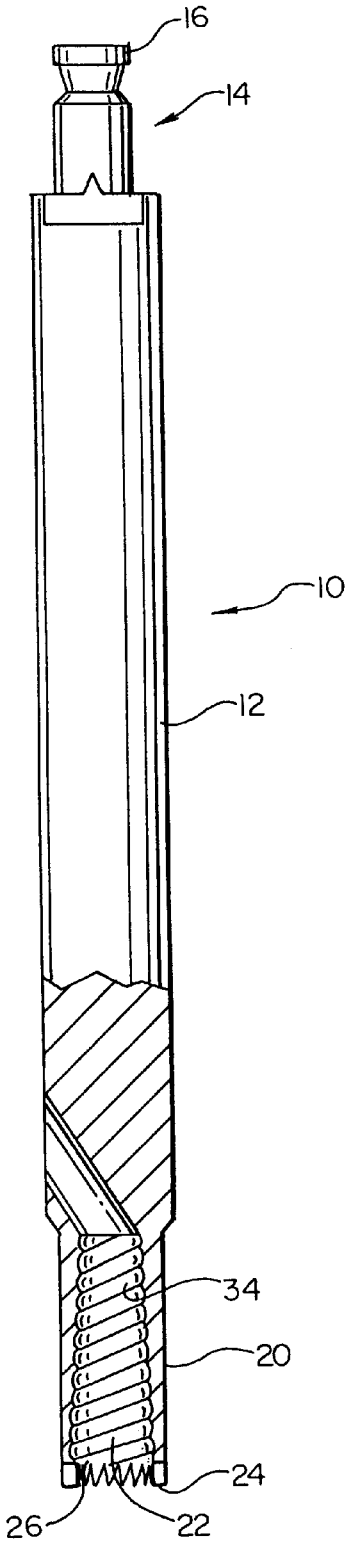
FIG. 1 is a side elevational view of the extractor partially cutaway to show the interior of the tapered, threaded opening.
Figure 2:
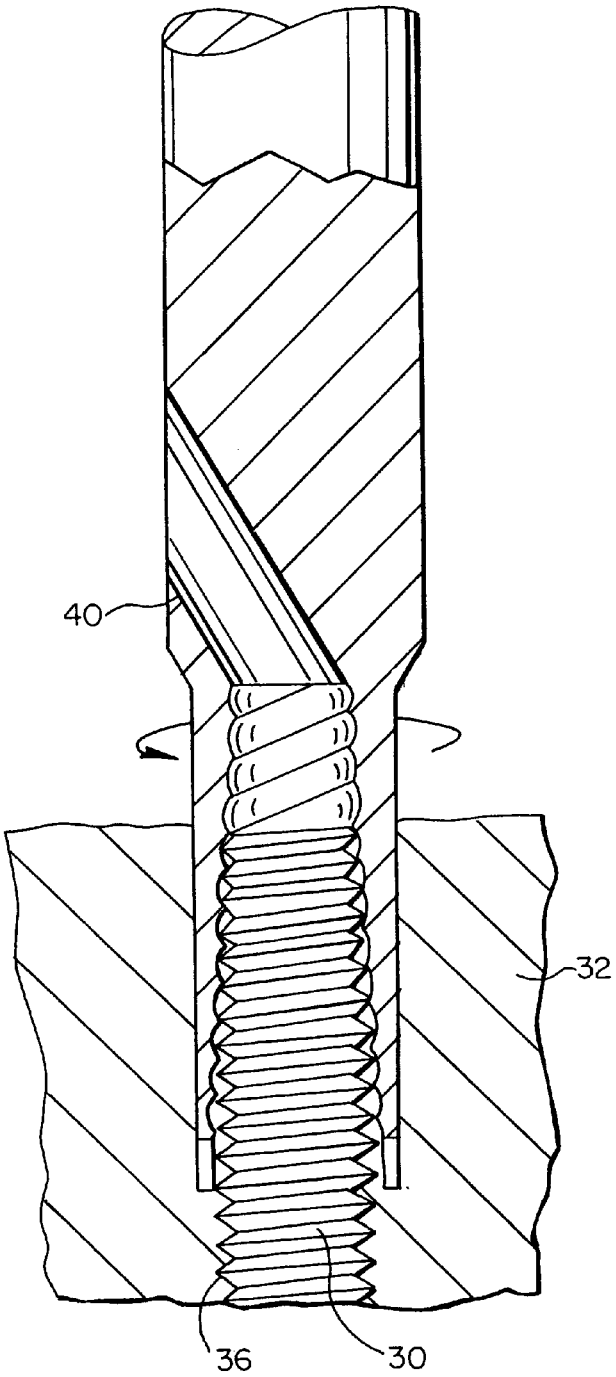
FIG. 2 is an enlarged view of the lower end positioned over a screw and the hole saw has cut away the bone such that the tapered threads grab the screw to allow it to be extracted.

The lower end 20 includes a centered opening 22 leading back toward upper end 14 as shown in the figures. The opening 22 defines a lower periphery 24 which functions as a hole saw. The lower periphery includes one or more cutting surfaces or teeth 26 which are constructed and arranged to cut a circular hole around a screw 30 inserted into a substrate 32. The opening 22 is shown in the figures as a tapered, threaded opening with the taper decreasing in diameter toward the upper end 14. As best shown in FIG. 2, the tapered threaded opening 22 passes over a screw 30 to be removed and the taper of the opening forces threads 34 of the opening 22 to bear against the screw 30 as the extractor 10 is rotated. Since the threads 34 of the extractor are opposite screw threads 36, rotation of the extractor will bite into the screw and back the screw 30 out of the substrate 32.

FIG. 2 shows a broken off screw 30 which has no head projecting above the substrate 32. In such cases, there is nothing above the surface of the substrate which may be grabbed by an extractor. Therefore, the extractor 10 of the invention includes the hole saw feature via the cutting edges 26 on the lower periphery 24 to allow the substrate 32 to be cut away sufficiently by the extractor 10 until the tapered threads 34 are able to bite into the screw 30 to force its removal by reverse rotation to the screw threads 36.

Figure 3:
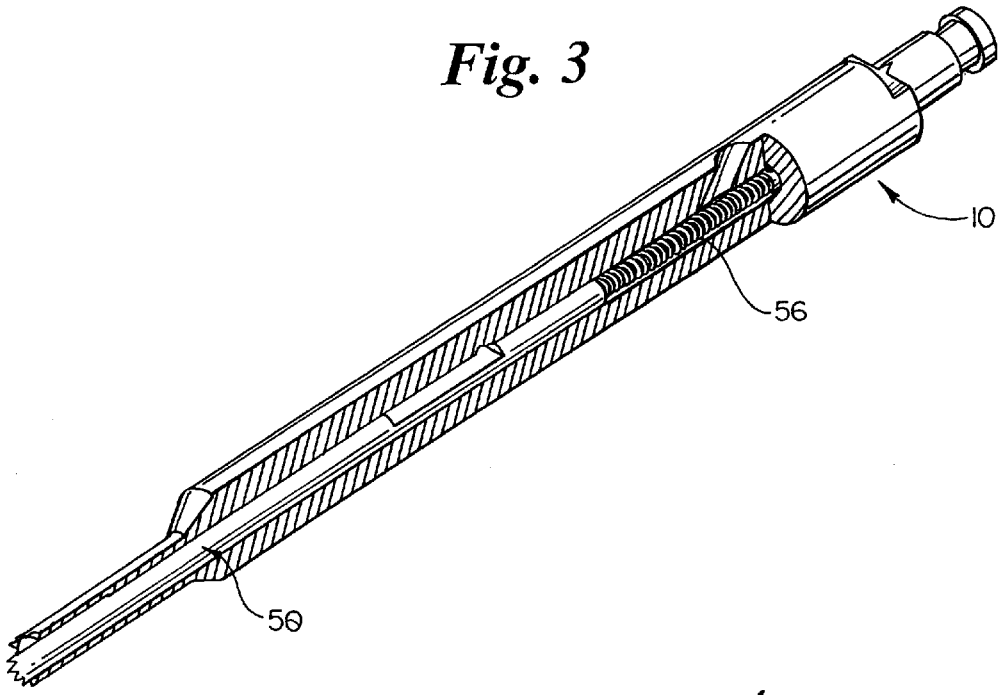
FIG. 3 is a perspective view of an alternative embodiment of the invention with parts broken away showing a centering tool.
Figure 4:
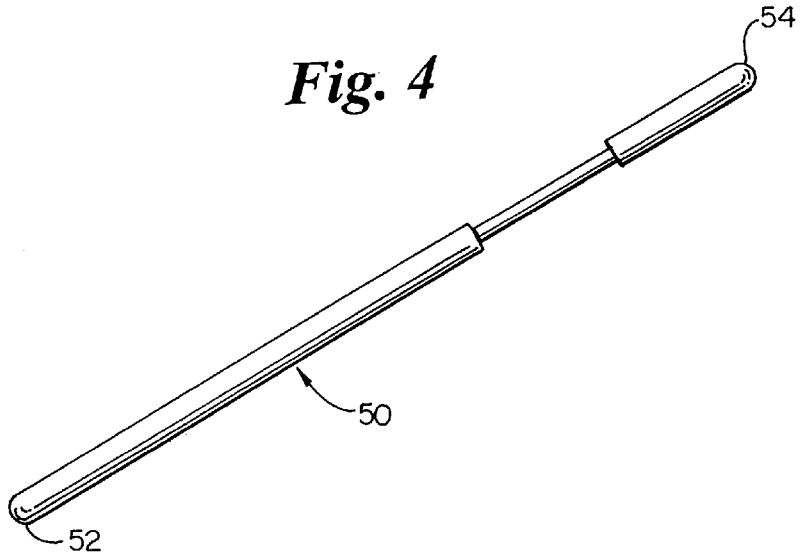
FIG. 4 is a side elevational view of the centering tool in the extractor.

FIGS. 3 and 4 show an alternative construction of the extractor 10 in which opening 22 extends nearly through the extractor to provide room for a centering tool 50 which is an elongated rod having a screw contacting end 52 and a distal end 54 which abuts against a coil spring 56 to spring load the centering tool 50. Tool 50 is utilized when the screw to be extracted is below the surface of the bone or wood, such as when the screw shaft has been broken. In such cases, the extractor 10 is more difficult to start centered without a guide and may wander while rotated. The spring loaded centering tool 50 may be positioned in the recess where the broken screw top was which provides centering for the extractor to begin cutting around the shaft of the screw. The spring 56 allows the extractor 10 to descend downwardly while still centered.

The figures show that the upper end of opening 22 may communicate with a clean-out opening 40 which allows material in the opening 22 to be removed through the clean-out. Alternatively, the clean-out 40 allows material to be pushed out of opening 22 at the lower end 20 by inserting a cleaning rod through the clean-out toward the lower end 20. Note that the clean-out 40 may exit out of upper end 14, especially if the extractor is substantially hollow.

The tapered threads 34 in opening 22 have been shown as cutting threads in a left-handed helix. Use of the term "tapered threads" and "tapered cutting threads" is intended to cover any tapered opening that has a mechanism that can bite into the screw 30 so a removal force may be placed onto the screw. For example, longitudinal edged flutes may be employed instead of the simple threads as shown in the figures.

The extractor of the invention is particularly suited to removal of screws in bone as it does not require drilling a pilot hole in a metal screw which creates metal filings, generates heat and is time consuming. However, the invention may also be used to remove screws from any material which is substantially softer than the screw, such that it is far easier to cut away some of the softer substrate to enable the tapered threads to bite into the screw to be removed. Removal of metal screws from plastic and wood are examples of other applications of the extractor of the invention.

While this invention may be embodied in many different forms, there are shown in the drawings and described in detail herein specific preferred embodiments of the invention. The present disclosure is an exemplification of the principles of the invention and is not intended to limit the invention to the particular embodiments illustrated.

This completes the description of the preferred and alternate embodiments of the invention. Those skilled in the art may recognize other equivalents to the specific embodiment described herein which equivalents are intended to be encompassed by the claims attached hereto.

What is claimed is:

1. A screw extractor for removing broken or damaged screws from bone or wood, said extractor comprising:

(a) an elongated shaft having a first and a second end, said first end including a head constructed and arranged to allow transmission of rotational force to said extractor;

(b) said second end of said shaft having a tapered, threaded opening leading toward said first end and defining a hole saw at the lowest portion of said second end, wherein the spatial relationship between the threaded opening and the hole saw remains constant such that the rotational force drives both the hole saw to cut through the bone or wood around said screw allowing the threaded opening access to the screw and the threaded opening to engage the screw, said tapered, threaded opening being sized to initially pass over said screw and to abut against said screw as said screw passes further up into said opening, said tapered threads being opposite to the thread direction of said screw.

2. The extractor of claim 1 wherein said hole saw includes at least one cutting edge to describe a circular cutting path.

3. The extractor of claim 1 wherein said tapered, threaded opening consists of a left handed helical screw.

4. The extractor of claim 1 wherein said first end includes a Hudson adaptor.

5. A screw extractor for removing broken or damaged screws from bone or wood, said extractor comprising:

(a) an elongated shaft having a first and a second end, said first end including a head constructed and arranged to allow transmission of rotational force to said extractor;

(b) said second end of said shaft having a tapered, threaded opening leading toward said first end and defining a hole saw at the lowest portion of said second end, said tapered, threaded opening being sized to initially pass over said screw and to abut against said screw as said screw passes further up into said opening, said tapered threads being opposite to the thread direction of said screw, wherein said opening passes out of said extractor remote from said second end to provide a clean-out access to said extractor.

6. The extractor of claim 5 wherein said hole saw includes at least one cutting edge to describe a circular cutting path.

7. The extractor of claim 5 wherein said tapered, threaded opening consists of a left handed helical screw.

8. The extractor of claim 5 wherein said first end includes a Hudson adaptor.

9. A screw extractor for removing broken or damaged screws from bone or wood, said extractor comprising:

(a) an elongated shaft having a first and a second end, said first end including a head constructed and arranged to allow transmission of rotational force to said extractor;

(b) said second end of said shaft having a tapered, threaded opening leading toward said first end and defining a hole saw at the lowest portion of said second end, said tapered, threaded opening being sized to initially pass over said screw and to abut against said screw as said screw passes further up into said opening, said tapered threads being opposite to the thread direction of said screw, said extractor further including a centering tool consisting of an elongated rod which may be positioned within said opening of said extractor against a spring member such that an end of said elongated rod may extend out of said opening beyond said hole saw to center the extractor on a broken screw, said elongated rod residing entirely within said opening when said spring member is compressed.

10. A tool for extracting broken or damaged screws embedded in material softer than said screw, said tool comprising:

(a) an elongated shank having an upper and a lower end;

(b) said upper end including a mechanism for receiving externally applied rotational force;

(c) said lower end including an a centrally located opening defining a lower circular periphery and a tapered screw engaging interior constructed and arranged to pass over said screw and cut into and secure to said screw when rotated counter to the threads of said screw; and (d) said lower circular periphery having a terminal end which defines a cutting portion, wherein the spatial relationship between the lower circular periphery and the cutting portion remains constant to cut away said material surrounding said embedded screw so as to allow said extractor to descend down onto said screw in order for said tapered interior to engage with said screw.

11. A method for removing broken or damaged screws in bone or wood comprising the steps of:

(a) obtaining a screw extractor having an elongated shaft with a first and a second end, said first end including a head constructed and arranged to allow transmission of rotational force to said extractor by a force supplying tool, said second end defining a hole saw and inwardly tapered cutting threads in an opening defined by said hole saw, wherein the spatial relationship between the inwardly tapered cutting threads and the hole saw remains constant;

(b) positioning said second end of said extractor over a screw to be removed;

(c) applying rotational force to said extractor at said first end to turn said extractor counter to the direction of threads of said screw to thereby drive said hole saw and cut away the bone or wood surrounding said screw; and (d) continuing said rotational force to said extractor to cause said extractor to pass over said screw until the tapered cutting threads engage against said screw and thereby backs out said screw from said bone or wood.

* * * * *